US008569725B2

(12) United States Patent
Shimazu

(10) Patent No.: US 8,569,725 B2
(45) Date of Patent: Oct. 29, 2013

(54) RADIATION SHIELDING METHOD AND RADIATION SHIELDING DEVICE

(75) Inventor: Yukihide Shimazu, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 204 days.

(21) Appl. No.: 13/056,907

(22) PCT Filed: Sep. 18, 2009

(86) PCT No.: PCT/JP2009/066385

§ 371 (c)(1),
(2), (4) Date: Jan. 31, 2011

(87) PCT Pub. No.: WO2010/073782

PCT Pub. Date: Jul. 1, 2010

(65) Prior Publication Data

US 2011/0127451 A1 Jun. 2, 2011

(30) Foreign Application Priority Data

Dec. 26, 2008 (JP) ..... 2008-335198

(51) Int. Cl.
*G21F 1/00* (2006.01)
*G21F 3/00* (2006.01)

(52) U.S. Cl.
USPC ..... 250/515.1; 250/505.1; 250/518.1

(58) Field of Classification Search
USPC ..... 250/505.1, 506.1, 507.1, 517.1, 518.1, 250/519.1
See application file for complete search history.

(56) References Cited

U.S. PATENT DOCUMENTS

| | | | | |
|---|---|---|---|---|
| 3,608,555 | A * | 9/1971 | Greyson | 600/435 |
| 4,447,734 | A | 5/1984 | Kusumegi et al. | |
| 4,836,937 | A * | 6/1989 | Homer | 210/808 |
| 2002/0124759 | A1 | 9/2002 | Amick | |
| 2004/0254419 | A1 * | 12/2004 | Wang et al. | 600/8 |
| 2005/0004290 | A1 | 1/2005 | Kai et al. | |

FOREIGN PATENT DOCUMENTS

| | | | |
|---|---|---|---|
| EP | 1 338 626 | A1 | 8/2003 |
| JP | 50-84799 | A | 7/1975 |
| JP | 55-17415 | A | 2/1980 |
| JP | 58-76200 | U | 5/1983 |

(Continued)

OTHER PUBLICATIONS

Decesion of a Patent Grant issued Jun. 5, 2012 in corresponding Japanese Patent Application No. 2008-335198. (3 pages).

(Continued)

*Primary Examiner* — Nicole Ippolito
(74) *Attorney, Agent, or Firm* — Westerman, Hattori, Daniels & Adrian, LLP

(57) ABSTRACT

To include a step of installing a hollow container (1) at a predetermined portion of an object to be shielded (100), a step of feeding fluid into the container (1) via a hose (22) by a fluid feeding unit (2), and a step of transporting and filling a granular shielding material into the container (1) via the hose (22) by supplying the shielding material to the fluid by a shielding-material supply unit (3). With this arrangement, because a shielding material is fed into the container (1) together with the fluid and filled therein at a remote place from the object to be shielded (100), a worker does not need to approach the object to be shielded (100). Further, because a shielding effect is improved by the granular shielding material, an amount of radiation to the worker can be reduced easily and sufficiently.

8 Claims, 11 Drawing Sheets

(56) References Cited

FOREIGN PATENT DOCUMENTS

| | | | |
|---|---|---|---|
| JP | 59-11880 | A | 3/1984 |
| JP | 61-154598 | U | 9/1986 |
| JP | 4-305198 | A | 10/1992 |
| JP | 6-230178 | A | 8/1994 |
| JP | 9-049888 | A | 2/1997 |
| JP | 9-304588 | A | 11/1997 |
| JP | 10-102789 | A | 4/1998 |
| JP | 2001-343479 | A | 12/2001 |
| JP | 2003-004892 | A | 1/2003 |
| JP | 2003-080192 | A | 3/2003 |

OTHER PUBLICATIONS

Japanese Office Action issued Apr. 24, 2012 in corresponding Japanese Patent Application No. 2008-335198. (6 pages).

Internation Search Report of PCT/JP2009/066385, date of mailng date Oct. 27, 2009.

Written opinion of The International Searching Authority dated Olctober 27, 2009, issued in International Application No. PCT/JP2009/066385.

* cited by examiner

RADIATION SHIELDING METHOD AND RADIATION SHIELDING DEVICE

FIELD

The present invention relates to a radiation shielding method and a radiation shielding device applied when an operation such as a plant outage or repair is performed in a nuclear power plant, for example.

BACKGROUND

In nuclear power plants, plant outages are performed for the structure thereof. Appropriate repair is performed for a part where it is considered that repair is required according to the plant outage. Thus, in nuclear power plants, operations such as plant outages and repair are required to maintain normal operating conditions. In such operations, it is necessary to reduce an amount of radiation to workers.

Taking this necessity into account, there can be considered an installation of a wall-shaped shielding material that shields radiation in a structure, which is an object to be shielded. However, to reduce the amount of radiation, a shielding material having a weight of, for example, 100 kilograms or more is required. It is not easy to transport such a heavy shielding material to a checking location or a repair location. Further, there is an idea that the shielding material can be divided into pieces of about 10 kilograms; however, because a long installation time is required in a higher or narrower location, there is a concern about exposure to radiation of workers at the time of installing the shielding material.

Conventionally, for example, Patent Literature 1 discloses a pipe cleaning method in which a cleaning area and a non-cleaning area of a pipe are isolated from each other by simple means. According to this cleaning method, a balloon is inserted into a boundary between the cleaning area and the non-cleaning area of the pipe, air or fluid such as water is supplied into the balloon to pressurize the balloon, thereby isolating the cleaning area of the pipe from the non-cleaning area.

That is, it can be considered to apply the conventional cleaning method at the time of performing a plant outage or repair of a nuclear power plant, in which radiation is easily shielded by a shielding body in which water is filled in a balloon, thereby reducing the amount of radiation to a worker.

CITATION LIST

Patent Literature

Patent Literature 1: Japanese Patent Application Laid-open No. 2003-80192

SUMMARY

Technical Problem

However, according to the radiation shielding method and the radiation shielding device that supplies water into a balloon, although it is effective in a place where the amount of radiation is relatively small, radiation may not be shielded effectively in a place where the amount of radiation is relatively large.

The present invention has been achieved to solve the problems described above, and an object of the present invention is to provide a radiation shielding method and a radiation shielding device that can reduce an amount of radiation to a worker easily and sufficiently.

Solution to Problem

According to an aspect of the present invention, a radiation shielding method includes: installing a hollow container at a predetermined portion of an object to be shielded; feeding fluid into the container via a feeding hose; and supplying a shielding material to the feeding hose and transporting and filling a granular shielding material into the container by the fluid.

According to the radiation shielding method, a worker approaches the object to be shielded at the time of installing the container. However, because the granular shielding material is fed together with fluid into the container installed in the object to be shielded at a remote place via the feeding hose, the worker does not need to approach the object to be shielded, and further, the shielding effect can be improved by the granular shielding material. Therefore, the amount of radiation to the worker can be reduced easily and sufficiently.

Advantageously, in the radiation shielding method, at the feeding fluid into the container, liquid is used as the fluid and the liquid is filled in the container via the feeding hose.

According to the radiation shielding method, because the shielding material settles down in the fluid filled in the container and gradually accumulates on a bottom of the container, the shielding material can be filled in the container tidily, and a radiation shielding effect can be obtained sufficiently.

Advantageously, the radiation shielding method further includes: extracting the shielding material filled in the container from the container together with fluid discharged to outside of the container via a returning hose, while feeding fluid into the container via a feeding hose, in a state that the shielding material is filled in the container; and recovering the shielding material from the fluid.

According to the radiation shielding method, because the shielding material can be recovered from the container together with fluid at a remote place from the object to be shielded, a worker does not need to approach the object to be shielded, thereby enabling to reduce the amount of radiation to the worker easily and sufficiently.

Advantageously, in the radiation shielding method, the container is mounted on the object to be shielded at all times.

According to the radiation shielding method, an operation of installing the container in the object to be shielded can be omitted at the time of a plant outage or repair, thereby enabling to further reduce the amount of radiation to the worker.

According to another aspect of the present invention, a radiation shielding device includes: a hollow container installed at a predetermined portion of an object to be shielded; a fluid feeding unit that feeds fluid into the container via a feeding hose; and a shielding-material supply unit that supplies a granular shielding material to the feeding hose.

According to the radiation shielding device, the radiation shielding method described above can be performed. As a result, a worker approaches the object to be shielded at the time of installing the container. However, because the granular shielding material is fed together with fluid into the container installed in the object to be shielded at a remote place via the feeding hose, the worker does not need to approach the object to be shielded, and further, the shielding effect can be improved by the granular shielding material. Therefore, the amount of radiation to the worker can be reduced easily and sufficiently.

Advantageously, the radiation shielding device includes: a shielding-material extracting unit that circulates the shielding material filled in the container together with fluid discharged to outside of the container via a returning hose, while feeding fluid into the container via a feeding hose; and a shielding-material recovering unit that recovers the shielding material from the fluid.

According to the radiation shielding device, the radiation shielding method described above can be performed. As a result, because the shielding material can be recovered from the container together with fluid at a remote place from the object to be shielded, a worker does not need to approach the object to be shielded, thereby enabling to reduce the amount of radiation to the worker easily and sufficiently.

Advantageously, in the radiation shielding device, the shielding-material extracting unit includes an injection nozzle that injects the fluid fed into the container, and a fetching member having an inlet for fetching the shielding material together with fluid discharged from the container, which are provided in the container, and an injection port of the injection nozzle is arranged toward the inlet of the fetching member.

According to the radiation shielding device, because fluid is injected from the injection port of the injection nozzle toward the inlet of the fetching member, a swirling current is generated at a position of the inlet. Therefore, the shielding material near the inlet is stirred by the swirling current and introduced into the fetching member from the inlet, and extracted to the returning hose. As a result, clogging of the shielding material at the inlet can be avoided.

Advantageously, in the radiation shielding device, the shielding-material extracting unit includes a switching unit that switches a feeding direction of fluid in a reverse flow mode of the fluid.

According to the radiation shielding device, by feeding fluid in a reverse direction by the switching unit, the fluid flowing back in the returning hose for discharging the fluid to outside of the container is fed into the container. Therefore, the shielding material is blown into the container, thereby removing clogging.

Advantageously, in the radiation shielding device, the hose for circulating the shielding material together with fluid between the shielding-material supply unit and the container is made to be transparent.

According to the radiation shielding device, the shielding material being fed via the hose can be visually checked, and thus clogging of the shielding material can be recognized.

Advantageously, in the radiation shielding device, the hose for circulating the shielding material together with fluid between the shielding-material recovering unit and the container is made to be transparent.

According to the radiation shielding device, the shielding material being fed via the hose can be visually checked, and thus clogging of the shielding material can be recognized.

Advantageously, in the radiation shielding device, water is used as the fluid, and a pellet containing tungsten is used as the shielding material.

According to the radiation shielding device, a pellet containing tungsten obtained by solidifying tungsten powder in a granular form by a resin material can be reused for subsequent radiation shielding, and also can be incinerated. As a result, handling of the pellet used for radiation shielding becomes easy.

Advantageous Effects of Invention

According to the present invention, because a granular shielding material is fed together with fluid into a container installed in an object to be shielded at a remote place via a hose, a worker does not need to approach the object to be shielded, and the shielding effect can be improved by the granular shielding material. Therefore, the amount of radiation to the worker can be reduced easily and sufficiently.

DESCRIPTION OF EMBODIMENTS

Exemplary embodiments of a radiation shielding method and a radiation shielding device according to the present invention will be explained below in detail with reference to the accompanying drawings. The present invention is not limited to the embodiments. In addition, constituent elements in the following embodiments include those that can be easily replaced by persons skilled in the art or that are substantially equivalent.

The radiation shielding method and the radiation shielding device according to the present invention are applied to general nuclear power plants such as a pressurized water reactor (PWR) and a boiling water reactor (BWR). Particularly, the radiation shielding method and the radiation shielding device according to the present invention are suitable when operations such as a plant outage and repair are performed in the general nuclear power plants.

Figure 1:
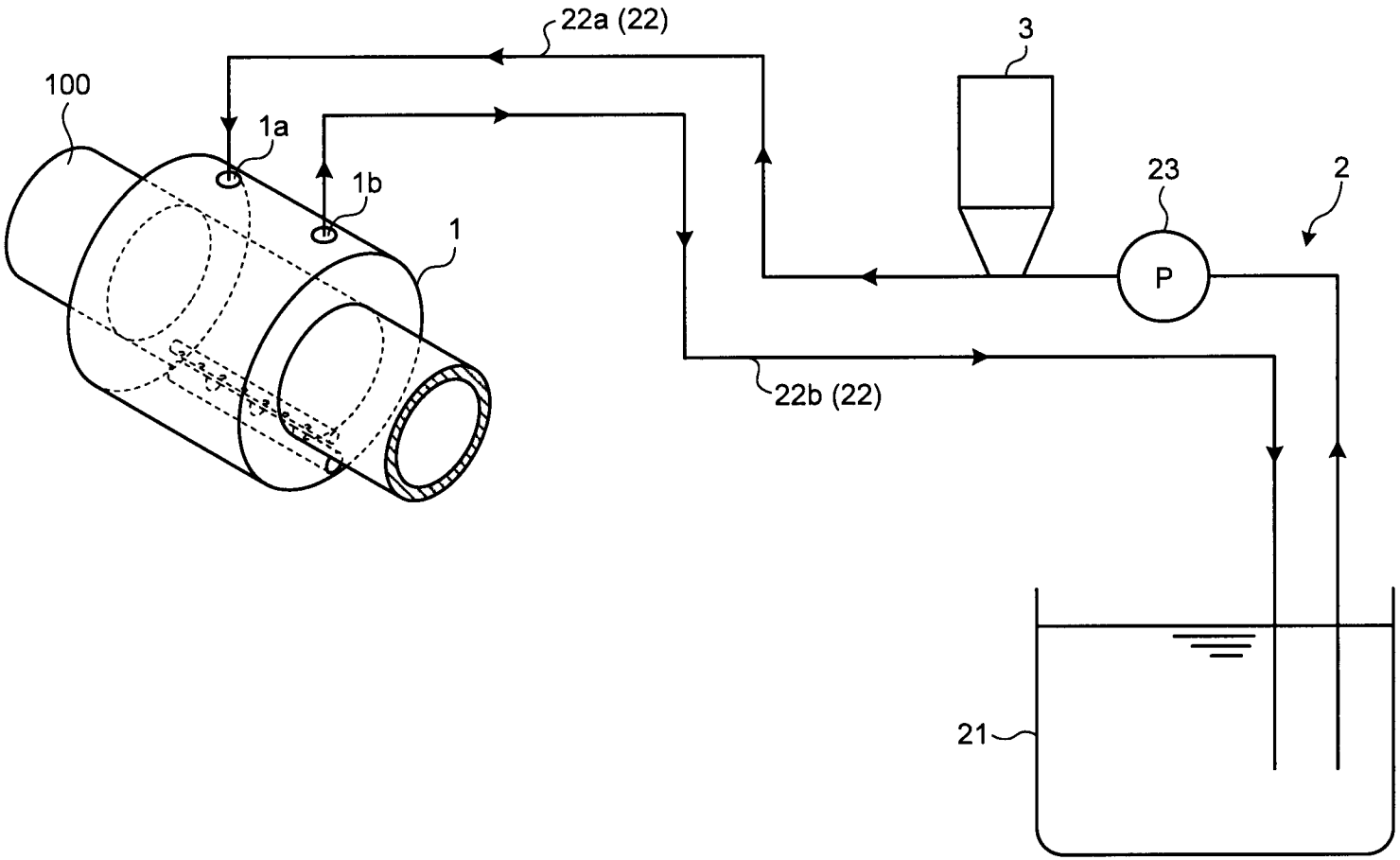
FIG. 1 is a schematic diagram of a radiation shielding device according to an embodiment of the present invention.
Figure 2:
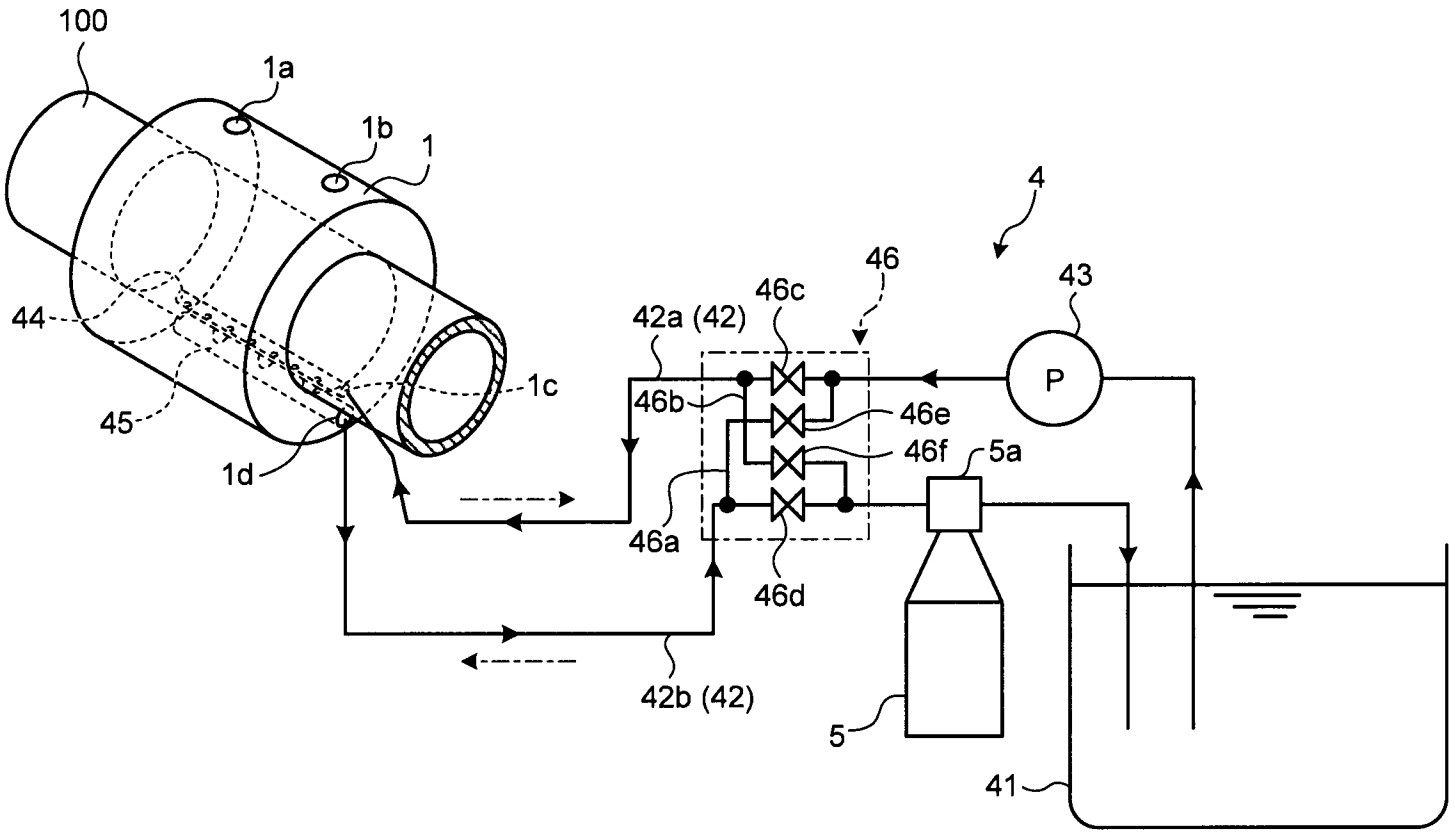
FIG. 2 is a schematic diagram of the radiation shielding device according to the embodiment of the present invention.
Figure 3:
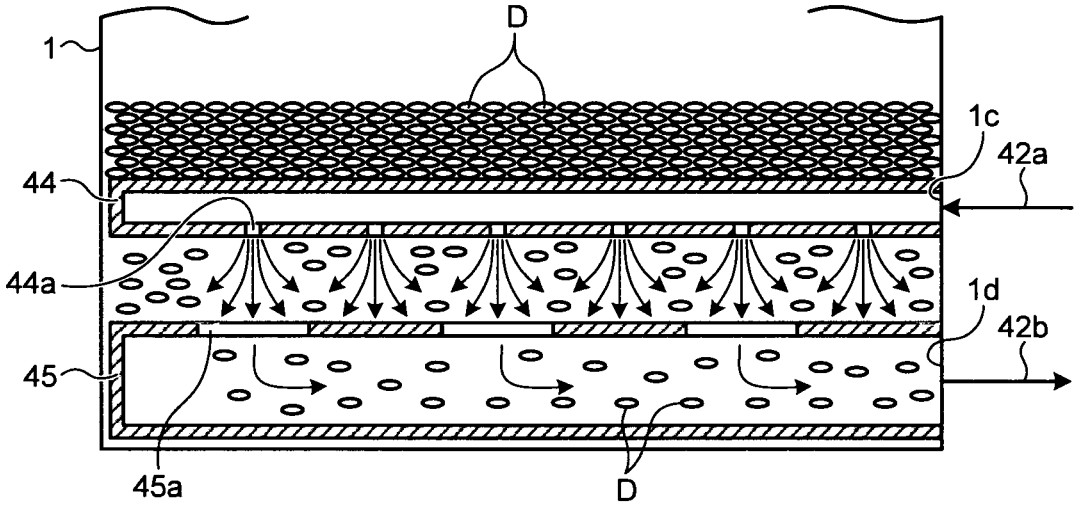
FIG. 3 is a schematic diagram of an injection nozzle and a fetching member according to the embodiment of the present invention.

FIGS. 1 and 2 are schematic diagrams of a radiation shielding device according to an embodiment of the present invention, and FIG. 3 is a schematic diagram of an injection nozzle and a fetching member of a shielding-material extracting unit.

As shown in FIG. 1, the radiation shielding device according to the present embodiment includes a container 1 installed at a predetermined portion of an object to be shielded 100, a fluid feeding unit 2 that feeds fluid into the container 1, and a shielding-material supply unit 3 that supplies a granular shielding material to the fluid fed into the container 1.

The container 1 shown in FIG. 1 is formed in a shape that covers a periphery of the object to be shielded 100 in a tubular shape, in order to reduce exposure to radiation from the object to be shielded 100 in a tubular shape. The container 1 is formed in a hollow shape, and for example, made of a material having flexibility and retractility such as stainless steel, plastic, or urethane rubber. When the container 1 is made of stainless steel or plastic, a high rigidity can be obtained. Meanwhile, when the container 1 is made of urethane rubber, because it can be folded small due to its flexibility, it is suitable for transport, and the container 1 can be closely stuck together with the object to be shielded 100 due to its retractility. Although not shown, it is preferable that an observation window is formed in the container so that the condition thereof can be visually checked from outside.

The fluid feeding unit 2 includes a tank 21, a hose 22, and a pump 23. Fluid to be fed into the container 1 is stored in the tank 21. For the fluid, water, pure water, boric-acid solution, polyvinyl alcohol, or silicon oil is used as a liquid, and air is used as a gas. In the present embodiment, the tank 21 is shown as a storage for storing liquid. The hose 22 connects the container 1 with the tank 21 to feed fluid between the container 1 and the tank 21, and includes a feeding hose 22*a* for feeding fluid from the tank 21 to the container 1, and a returning hose 22*b* for returning fluid from the container 1 to the tank 21. The hoses 22*a* and 22*b* are respectively connected to connection ports 1*a* and 1*b* provided in an upper part of the container 1. At least the feeding hose 22*a* of the hose 22 is made to be transparent, so that internal flowage can be visually checked from outside. The pump 23 is disposed intermediate of the feeding hose 22*a* to pump fluid in the tank 21 to the container 1.

The fluid feeding unit 2 feeds fluid stored in the tank 21 into the container 1 via the feeding hose 22*a* by an operation of the pump 23, and returns the fluid filled in the container 1 to the tank 21 via the returning hose 22*b*.

The shielding-material supply unit 3 is constituted as a so-called hopper that stores a shielding material and causes a fixed quantity of the shielding material to drop from a funnel-shaped bottom port of a drop-bottom type. The shielding-material supply unit 3 is provided on a downstream side of the pump 23 provided in the feeding hose 22*a* in the fluid feeding unit 2. As the shielding material stored in the shielding-material supply unit 3, pellets containing tungsten obtained by solidifying tungsten powder in a granular form by a resin material, stainless steel grains obtained by processing stainless steel in a granular form, lead grains obtained by processing lead in a granular form, and depleted uranium grains obtained by processing depleted uranium 1 in a granular form are used. It is preferable that such a shielding material is formed in the same grain shape and the same grain size so that deposition in the container 1 is equalized.

The shielding-material supply unit 3 supplies the stored shielding material to the feeding hose 22*a*. The supplied shielding material is pumped together with fluid in the feeding hose 22*a* and filled in the container 1. The shielding material in an amount to be filled in the container 1 is stored in the hopper as the shielding-material supply unit 3. Although not shown, a filter is provided in the connection port 1*b* of the container 1 connected with the returning hose 22*b*, so that the grains of the shielding material are not returned to the tank 21 together with the fluid.

Although not shown, the pump 23 of the fluid feeding unit 2 and the shielding-material supply unit 3 are mounted together on a carriage so that transport can be facilitated.

As shown in FIG. 2, the radiation shielding device according to the present embodiment further includes a shielding-material extracting unit 4 that extracts the shielding material from the container 1 together with fluid discharged from the container 1, while feeding fluid into the container 1, and a shielding-material recovering unit 5 that recovers the shielding material from fluid.

The shielding-material extracting unit 4 includes a tank 41, a hose 42, and a pump 43. Fluid to be fed into the container 1 is stored in the tank 41. The tank 21 of the fluid feeding unit 2 can be also used as the tank 41. For the fluid, water, polyvinyl alcohol, or silicon oil is used as a liquid, and air is used as a gas. In the present embodiment, the tank 41 is shown as a storage for storing liquid. The hose 42 connects the container 1 with the tank 41 to feed fluid between the container 1 and the tank 41, and includes a feeding hose 42*a* for feeding fluid from the tank 41 to the container 1, and a returning hose 42*b* for returning fluid from the container 1 to the tank 41. The hoses 42*a* and 42*b* are respectively connected to connection ports 1*c* and 1*d* provided on a bottom of the container 1. At least the returning hose 42*b* of the hose 42 is made to be transparent, so that internal flowage can be visually checked from outside. The pump 43 is disposed intermediate of the feeding hose 42*a* to pump fluid in the tank 41 to the container 1.

The shielding-material extracting unit 4 includes an injection nozzle 44 and a fetching member 45 provided on the bottom of the container 1. As shown in FIG. 3, the injection nozzle 44 is formed in a tubular shape, with one end thereof communicating with the connection port 1*c* to which the feeding hose 42*a* is connected, and the other end being closed. A plurality of injection ports 44*a* are provided in the injection nozzle 44 along an extending direction in a tubular shape. The fetching member 45 is formed in a tubular shape, with one end thereof communicating with the connection port 1*d* to which the returning hose 42*b* is connected, and the other end being closed. A plurality of inlets 45*a* is provided in the fetching member 45 along an extending direction in a tubular shape. The fetching member 45 is arranged on the bottom of the container 1, with the inlets 45*a* being directed upward. The injection nozzle 44 is arranged alongside the fetching member 45, with the injection ports 44*a* being directed toward the inlets 45*a* of the fetching member 45. In the present embodiment, the injection nozzle 44 is arranged above the fetching member 45, with the injection ports 44*a* being directed downward.

The shielding-material extracting unit 4 has a switching unit 46 for the feeding hose 42*a* and the returning hose 42*b*. The switching unit 46 includes first and second bypass pipes 46*a* and 46*b* that connect the feeding hose 42*a* and the returning hose 42*b* to each other. The first and second bypass pipes 46*a* and 46*b* cross each other and are connected to the feeding hose 42*a* and the returning hose 42*b*. The switching unit 46 also includes switching valves 46*c*, 46*d*, 46*e*, and 46*f*. The switching valve 46*c* is arranged between positions in the feeding hose 42*a* where the first and second bypass pipes 46*a* and 46*b* are respectively connected thereto, to allow flowage of fluid in an opened state, while stopping flowage of fluid in a closed state. The switching valve 46*d* is arranged between positions in the returning hose 42*b* where the first and second bypass pipes 46*a* and 46*b* are respectively connected thereto, to allow flowage of fluid in an opened state, while stopping flowage of fluid in a closed state. The switching valve 46*e* is arranged in the first bypass pipe 46*a*, to allow flowage of fluid in an opened state, while stopping flowage of fluid in a closed state. The switching valve 46*f* is arranged on the second bypass pipe 46*b*, to allow flowage of fluid in an opened state, while stopping flowage of fluid in a closed state.

The shielding-material extracting unit 4 feeds fluid stored in the tank 41 into the container 1 via the feeding hose 42*a* by an operation of the pump 43, with the switching valves 46*c* and 46*d* of the switching unit 46 being opened, and the switching valves 46*e* and 46*f* being closed (a direct flow mode). The fluid filled in the container 1 is then returned to the tank 41 via the returning hose 42*b*. When the fluid is returned from the container 1 to the tank 41 via the returning hose 42*b*, the shielding material in the container 1 is circulated together with the fluid into the returning hose 42*b*. The fluid fed into the container 1 via the feeding hose 42*a* is injected, as shown in FIG. 3, from the injection ports 44*a* of the injection nozzle 44 toward the inlets 45*a* of the fetching member 45, thereby causing a swirling current at the positions of the inlets 45*a*. Therefore, a shielding material D near the inlets 45*a* is introduced into the pipe of the fetching member 45 from the inlets 45*a* together with the fluid, while being stirred by the swirling current, and extracted to the returning hose 42*b*.

The shielding-material extracting unit 4 feeds fluid stored in the tank 41 into the container 1 via the returning hose 42*b*, bordering on the switching unit 46, as shown by the arrow of one-dot-chain line, by the operation of the pump 43, with the switching valves 46*c* and 46*d* of the switching unit 46 being closed, and the switching valves 46*e* and 46*f* being opened (a reverse flow mode). The fluid filled in the container 1 is then returned to the tank 41 via the feeding hose 42*a*. In this manner, when the fluid is reversely fed, the fluid is fed into the container 1 from the inlets 45*a* of the fetching member 45. Therefore, the shielding material D near the inlets 45*a* is blown into the container 1.

The shielding-material recovering unit 5 stores the shielding material. The shielding-material recovering unit 5 is provided in the returning hose 42*b* between the switching unit 46 and the tank 41 in the shielding-material extracting unit 4. Further, the shielding-material recovering unit 5 is connected to the returning hose 42*b* via a filter 5*a*. The filter 5*a* causes the fluid fed by the returning hose 42*b* to flow directly, while stopping and dropping the shielding material into the shielding-material recovering unit 5.

Although not shown, the pump 43 and the switching unit 46 of the shielding-material extracting unit 4, and the shielding-material recovering unit 5 are both mounted on a carriage so that transport can be facilitated.

According to the radiation shielding method using the radiation shielding device configured in this manner, the hollow container 1 is first installed at a predetermined portion of the object to be shielded 100. The fluid feeding unit 2 and the shielding-material supply unit 3 are then installed. At this time, the connection ports 1*c* and 1*d* of the container 1 are closed. Fluid (liquid is used here as the fluid) is fed to the container 1 via the fluid feeding unit 2, thereby filling the container 1 with the fluid. The shielding material is supplied by the shielding-material supply unit 3, while feeding the fluid into the container 1 by the fluid feeding unit 2. Accordingly, the shielding material is fed into the container 1. At this time, the shielding material settles down in the fluid filled in the container and gradually accumulates on the bottom of the container. Further, because the feeding hose 22*a* is made to be transparent, the shielding material being fed through the feeding hose 22*a* can be visually checked, thereby enabling to recognize clogging of the shielding material in the feeding hose 22*a*. Further, if an observation window is formed in the container 1, an internal condition in which the shielding material accumulates can be visually checked and recognized. When the shielding material is filled in the container 1, feed of fluid by the fluid feeding unit 2 is suspended, to remove the fluid feeding unit 2 and the shielding-material supply unit 3 and close the connection ports 1*a* and 1*b* of the container 1. As a result, the shielding material is filled in the container together with fluid, and thus exposure to radiation from the object to be shielded 100 can be reduced.

When shielding of radiation is not required, the container 1 is removed from the object to be shielded 100, as described below. First, the shielding-material extracting unit 4 and the shielding-material recovering unit 5 are installed. The switching unit 46 is turned into the reverse flow mode, to feed fluid into the container 1 by the shielding-material extracting unit 4. Accordingly, because fluid is fed from the inlets 45*a* of the fetching member 45 into the container 1, the shielding material near the inlets 45*a* is blown into the container 1, thereby removing clogging at the inlets 45*a*. The switching unit 46 is then turned to the direct flow mode, to feed fluid into the container 1 by the shielding-material extracting unit 4. The fluid filled in the container 1 is fed to the returning hose 42*b* together with the shielding material. The fluid is returned to the tank 41 by the shielding-material recovering unit 5, while the shielding material is stored in the shielding-material recovering unit 5. Accordingly, the shielding material filled in the container 1 is stored in the shielding-material recovering unit 5. Further, because the returning hose 42*b* is made to be transparent, the shielding material fed through the returning hose 42*b* can be visually checked, thereby enabling to recognize clogging of the shielding material in the fetching member 45 and the returning hose 42*b*. When there is clogging of the shielding material in the fetching member 45 or the returning hose 42*b*, the switching unit 46 is turned to the reverse flow mode to feed the fluid to the container 1 by the shielding-material extracting unit 4, thereby feeding the shielding material together with fluid from the inlets 45*a* of the fetching member 45 into the container 1 to remove clogging of the shielding material. When the entire shielding material filled in the container 1 is stored in the shielding-material recovering unit 5, feed of fluid by the shielding-material extracting unit 4 is suspended, and the shielding-material extracting unit 4, the shielding-material recovering unit 5, and the container 1 are removed, to finish the operation.

The radiation shielding method according to the present embodiment includes a step of installing the hollow container 1 at a predetermined portion of the object to be shielded 100, a step of feeding fluid into the container 1 via the feeding hose 22*a*, and a step of supplying the shielding material to the feeding hose 22*a* to transport and fill a granular shielding material into the container by the fluid.

According to the radiation shielding method, a worker approaches the object to be shielded 100 at the time of installing the container 1 and the hose 22 of the fluid feeding unit 2. However, in other cases, because the granular shielding material is fed into the container 1 together with fluid via the feeding hose 22*a* at a remote place from the object to be shielded 100, a worker does not need to approach the object to be shielded 100. Further, because the shielding effect can be improved by the granular shielding material, the amount of radiation to the worker can be reduced easily and sufficiently.

In the radiation shielding method according to the present embodiment, it is preferable that liquid is used as the fluid and filled in the container 1 via the feeding hose 22*a* at the step of feeding the fluid into the container 1 via the feeding hose 22*a*.

According to the radiation shielding method, because the shielding material settles down in the fluid filled in the container and gradually accumulates on the bottom of the container, the shielding material can be tidily filled in the container 1, thereby enabling to obtain the sufficient shielding effect of radiation.

The radiation shielding method according to the present embodiment further includes a step of extracting the shielding material filled in the container 1 from the container together with the fluid discharged to the outside of the container 1 via the returning hose 42*b*, while feeding the fluid into the container 1 via the feeding hose 42*a* in a state that the shielding material is filled in the container 1, and a step of recovering the extracted shielding material.

According to the radiation shielding method, because the shielding material can be recovered from the container 1 together with the fluid at a remote place from the object to be shielded 100, a worker does not need to approach the object to be shielded 100, thereby enabling to reduce the amount of radiation to the worker easily and sufficiently.

Further, in the radiation shielding method according to the present embodiment, it is preferable to mount the container 1 on the object to be shielded 100 at all times.

According to the radiation shielding method, an operation of installing the container 1 on the object to be shielded 100 can be omitted at the time of a plant outage or repair, thereby enabling to further reduce the amount of radiation to the worker.

The radiation shielding device according to the present embodiment described above includes the hollow container 1 installed at a predetermined portion of the object to be shielded 100, the fluid feeding unit 2 that feeds fluid into the container 1 via the feeding hose 22*a*, and the shielding-material supply unit 3 that supplies a granular shielding material to the feeding hose 22*a*.

According to the radiation shielding device, the radiation shielding method described above can be performed. As a result, a worker approaches the object to be shielded 100 at the time of installing the container 1 and the hose 22 of the fluid feeding unit 2. However, in other cases, because the shielding material is fed to the container 1 together with the fluid at a remote place from the object to be shielded 100, the worker does not need to approach the object to be shielded 100. Further, because the shielding effect can be improved by the granular shielding material, the amount of radiation to the worker can be reduced easily and sufficiently.

The radiation shielding device according to the present embodiment includes the shielding-material extracting unit 4 that circulates the shielding material together with the fluid discharged to the outside of the container 1 via the returning hose 42*b*, while feeding the fluid into the container 1 via the feeding hose 42*a*, and the shielding-material recovering unit 5 that recovers the shielding material from the fluid.

According to the radiation shielding device, the radiation shielding method described above can be performed. As a result, because the shielding material can be recovered from the container 1 together with the fluid at a remote place from the object to be shielded 100, a worker does not need to approach the object to be shielded 100, thereby enabling to reduce the amount of radiation to the worker easily and sufficiently.

Further, in the radiation shielding device according to the present embodiment, the shielding-material extracting unit 4 includes, in the container 1, the injection nozzle 44 that injects fluid fed into the container 1, and the fetching member 45 having the inlets 45*a* for fetching the shielding material together with the fluid discharged from the container 1, and the injection ports 44*a* of the injection nozzle 44 are arranged towards the inlets 45*a* of the fetching member 45.

According to the radiation shielding device, because fluid is injected from the injection ports 44*a* of the injection nozzle 44 toward the inlets 45*a* of the fetching member 45, a swirling current is generated at positions of the inlets 45*a*. Therefore, the shielding material near the inlets 45*a* is introduced into the pipe of the fetching member 45 from the inlets 45*a*, while being stirred by the swirling current, and is extracted to the returning hose 42*b*. As a result, clogging of the shielding material at the inlets 45*a* can be avoided. Particularly, in the radiation shielding device according to the present embodiment, the feeding hose 42*a* of the shielding-material extracting unit 4 is connected to the connection port 1*c* provided on the bottom of the container 1, and the shielding material is extracted from the feeding hose 42*a* into the container 1 together with fluid. Therefore, the shielding material accumulating on the bottom of the container 1 can be appropriately extracted.

In the radiation shielding device according to the present embodiment, the shielding-material extracting unit 4 includes the switching unit 46 that switches a feeding direction of fluid in a mode in which the fluid is reversely fed.

According to the radiation shielding device, by reversely feeding fluid by the switching unit 46, the fluid is fed into the container 1 from the inlets 45*a* of the fetching member 45. Therefore, the shielding material near the inlets 45*a* is blown into the container 1, thereby removing clogging at the inlets 45*a*.

In the radiation shielding device according to the present embodiment, the feeding hose 22*a* and the returning hose 42*b* that circulate the shielding material together with fluid are made to be transparent.

According to the radiation shielding device, the shielding material being fed via the feeding hose 22*a* and the returning hose 42*b* can be visually checked, and thus clogging of the shielding material can be recognized.

In the radiation shielding device according to the present embodiment, water is used as the fluid, and a pellet containing tungsten is used as the shielding material.

According to the radiation shielding device, water and the pellet containing tungsten can be reused for subsequent radiation shielding, and also can be incinerated. As a result, handling of what has been used for radiation shielding is facilitated.

In the radiation shielding device according to the present embodiment, the feeding hose 22*a* of the fluid feeding unit 2 is connected to the connection port 1*a* provided in the upper part of the container 1, and the shielding material supplied from the feeding hose 22*a* by the shielding-material supply unit 3 is fed into the container 1 together with fluid. Therefore, because the shielding material reaches the bottom of the container 1 from above, the shielding material can accumulate appropriately in the container 1. Further, in the radiation shielding method according to the present embodiment, after fluid (liquid is used here as the fluid) is filled in the container 1, the shielding material is supplied together with the fluid. Therefore, because the shielding material settles down in the liquid filled in the container 1 and gradually accumulates on the bottom of the container 1, the shielding material can accumulate appropriately in the container 1.

FIGS. 4 to 8 are schematic diagrams of a container used in the radiation shielding device.

Figure 4:
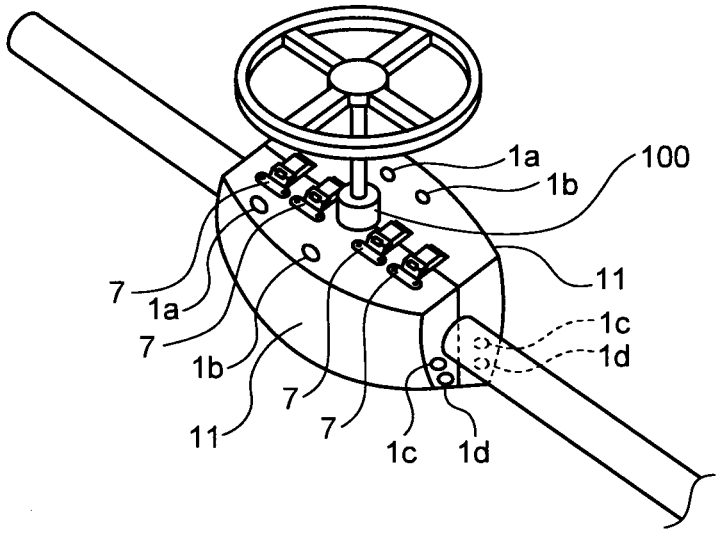
FIG. 4 depicts a container according to the embodiment of the present invention.

A container 11 shown in FIG. 4 is applied when the object to be shielded 100 is a valve installed in a pipe. In this case, it is preferable to use a pair of containers 11, 11 in combination, of which shapes are matched with the valve shape so that the valve is sandwiched from both sides. The respective containers 11, 11 are integrated by male and female engaging members 7 and fitted to the valve. Each of the containers 11 is provided with the connection ports 1*a*, 1*b*, 1*c*, and 1*d* like in the container 1, and although not shown, the injection nozzle 44 and the fetching member 45 are provided in the container 11 like in the container 1.

Figure 5:
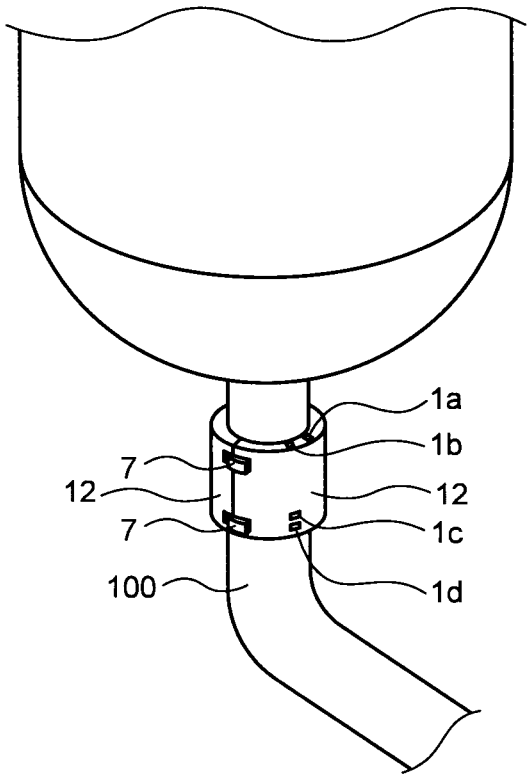
FIG. 5 depicts another container according to the embodiment of the present invention.

A container 12 shown in FIG. 5 is applied when the object to be shielded 100 is a pipe. In this case, it is preferable to use a pair of containers 12, 12 in combination, of which shapes are matched with the shape of the pipe so that the pipe is sandwiched from both sides. The respective containers 12, 12 are integrated by the male and female engaging members 7 and fitted to the pipe. Each of the containers 12 is provided with the connection ports 1*a*, 1*b*, 1*c*, and 1*d* like in the container 1, and although not shown, the injection nozzle 44 and the fetching member 45 are provided in the container 12 like in the container 1.

Figure 6:
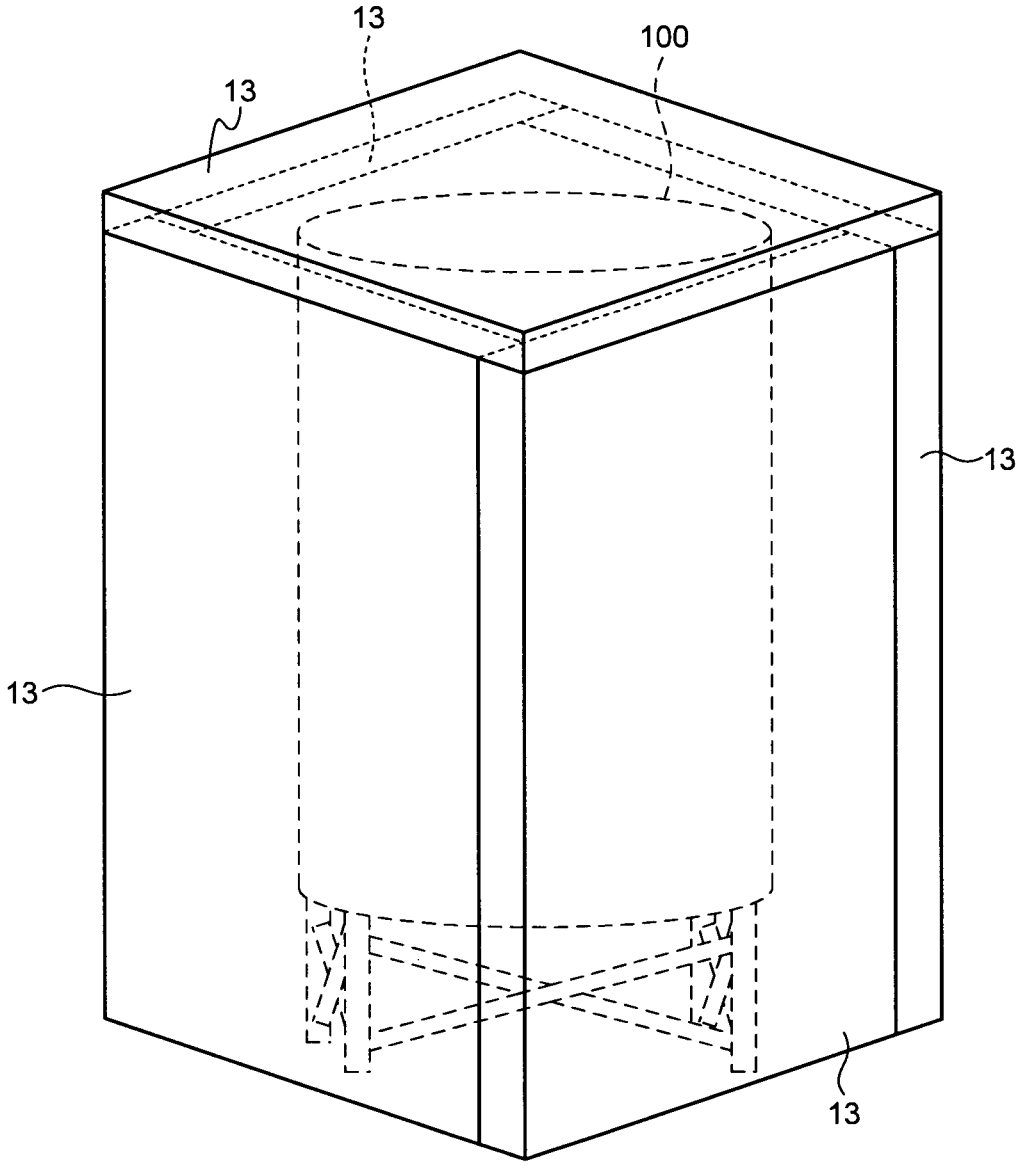
FIG. 6 depicts another container according to the embodiment of the present invention.

A container 13 shown in FIG. 6 is applied when the object to be shielded 100 is a large tank. In this case, it is preferable to use a plurality of wall-like containers 13, 13, 13, 13, and 13 to enclose the circumference of the tank. The respective containers 13, 13, 13, 13, and 13 are integrated by male and female engaging members and fitted to the circumference of the tank, although not shown. Each of the containers 13 is provided with the connection ports 1*a*, 1*b*, 1*c*, and 1*d* like in the container 1, and although not shown, the injection nozzle 44 and the fetching member 45 are provided in the container 13 like in the container 1.

Figure 7:
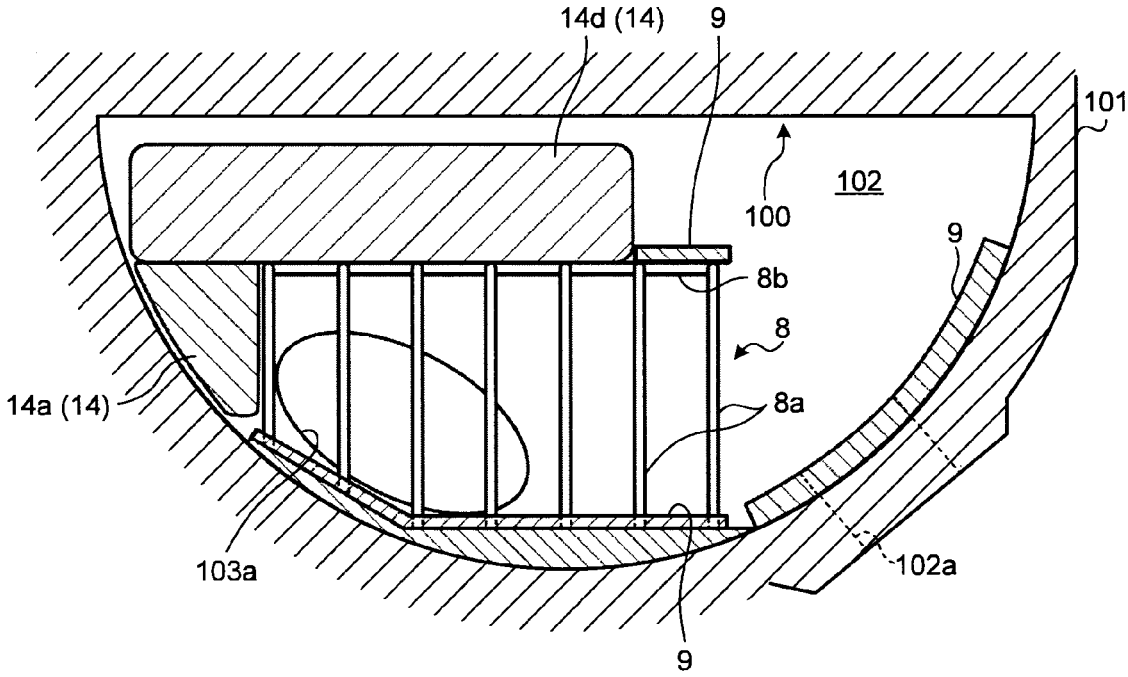
FIG. 7 depicts another container according to the embodiment of the present invention.
Figure 8:
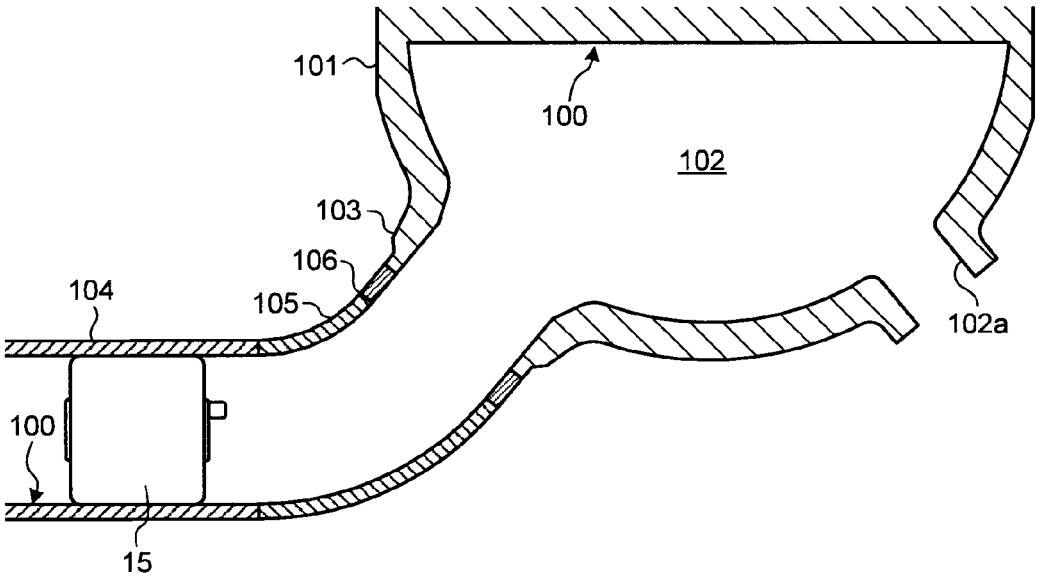
FIG. 8 depicts another container according to the embodiment of the present invention.

A container 14 shown in FIG. 7 and a container 15 shown in FIG. 8 are applied to a maintenance work of a steam generator nozzle in a nuclear power plant. For example, as a maintenance work of an inlet nozzle 103 of an inlet-side water chamber 102 of a steam generator 101, when repair of a welded part 106 between an elbow pipe 105 that connects the inlet nozzle 103 with a primary cooling pipe 104 and the inlet nozzle 103 is to be performed, inner walls of the inlet-side water chamber 102 and the primary cooling pipe 104 are the objects to be shielded 100. In repair of the welded part 106, because a worker enters into the inlet-side water chamber 102 from a manhole 102*a*, the container 14 is installed to follow the inner wall of the inlet-side water chamber 102 (see FIG. 7), and the container 15 is installed to block the inside of the primary cooling pipe 104 (see FIG. 8).

Installation of the container 14 shown in FIG. 7 is performed according to procedures shown in FIGS. 9 to 12. A support member 8 for supporting the container 14 is used here. The support member 8 forms a frame constituted of a stainless steel pipe material arranged to cover an opening 103*a* of the inlet nozzle 103 inside the inlet-side water chamber 102, and defines a desired work area around the opening 103*a* of the inlet nozzle 103. The support member 8 includes enclosing parts 8*a* in a downward U-shape arranged in parallel, extending across the opening 103*a* of the inlet nozzle 103, and a connecting part 8*b* that connects upper parts of the enclosing part 8*a*. The enclosing part 8*a* and the connecting part 8*b* are divided into a plurality of numbers, and brought into the inlet-side water chamber 102 from the manhole 102*a* by a worker.

Figure 9:
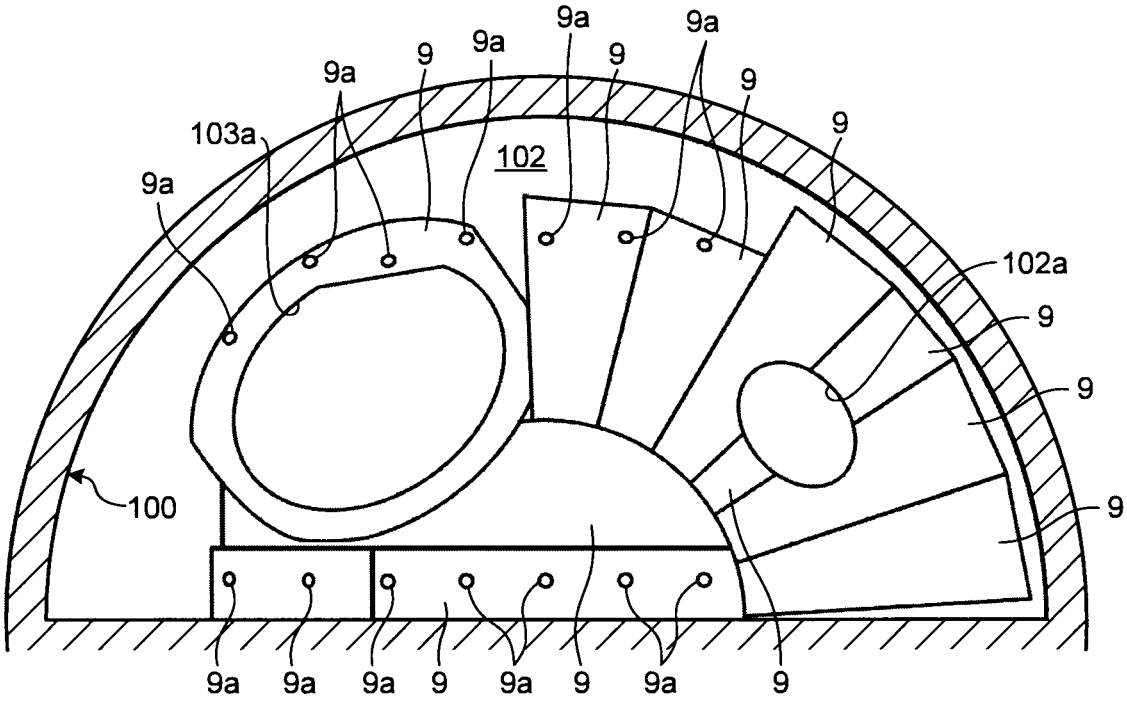
FIG. 9 depicts a step of installing the container shown in FIG. 7.
Figure 10:
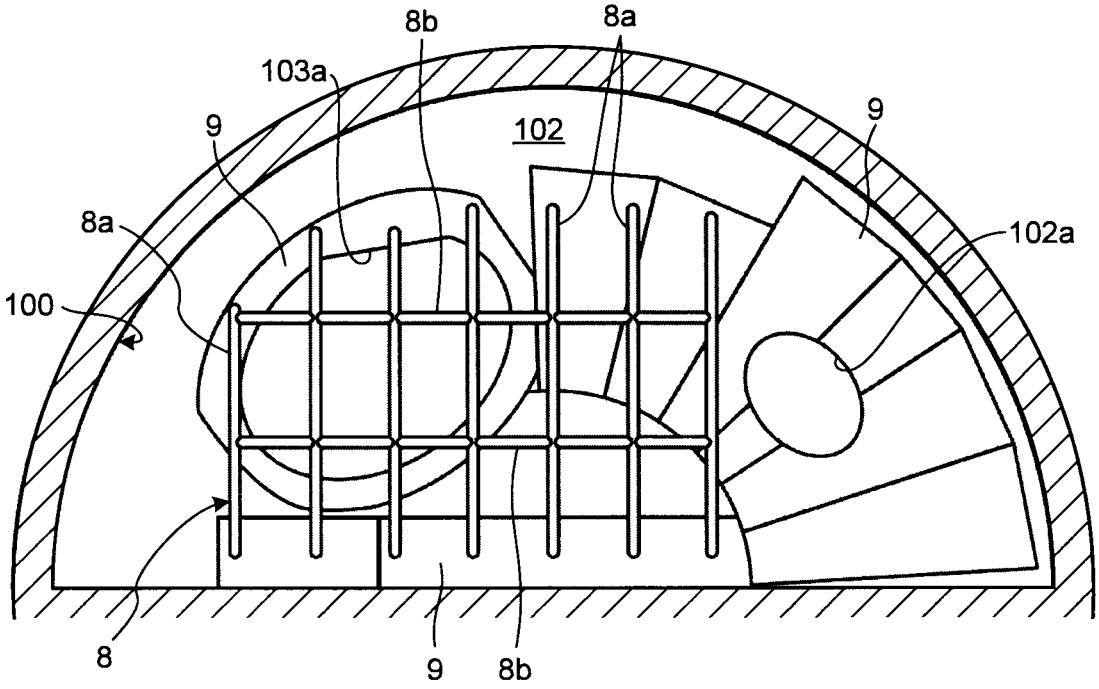
FIG. 10 depicts a step of installing the container shown in FIG. 7.

Further, to install the support member 8 inside the inlet-side water chamber 102, a base unit 9 is arranged on the bottom of the inlet-side water chamber 102. The base unit 9 is fitted to the bottom of the inlet-side water chamber 102 and laid therein, as shown in FIGS. 9 and 10, with the opening 103*a* of the inlet nozzle 103 and the manhole 102*a* being opened. Mounting holes 9*a* are formed on the base unit 9, into which respective ends of the enclosing parts 8*a* of the support member 8 are inserted. The base unit 9 is constituted by a member having a strength sufficient for supporting the support member 8 inserted into the mounting holes 9*a*, such as an aluminum plate, and includes a member that shields radiation, for example, a shielding material in which a plurality of tungsten sheets formed by mixing tungsten powder with a resin material are stacked on each other. The base unit 9 is divided into a plurality of numbers so that these divided parts are brought into the inlet-side water chamber 102 from the manhole 102*a* by a worker. When the base unit 9 does not include the mounting holes 9*a*, the base unit 9 is constituted only by the tungsten sheets.

Figure 11:
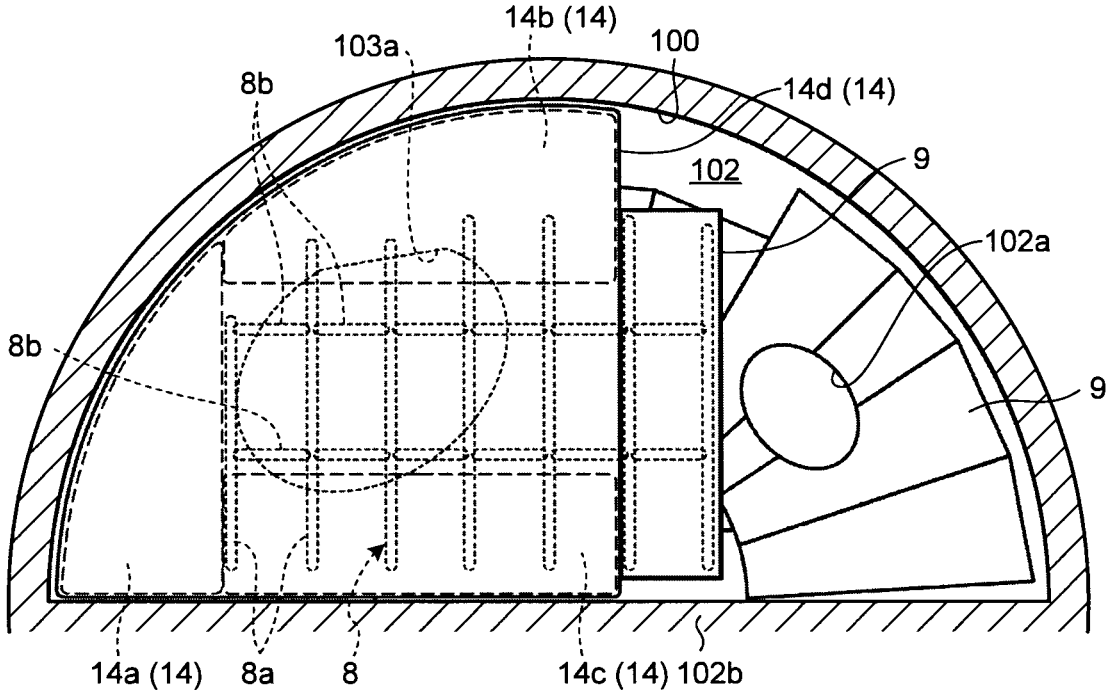
FIG. 11 depicts a step of installing the container shown in FIG. 7.
Figure 12:
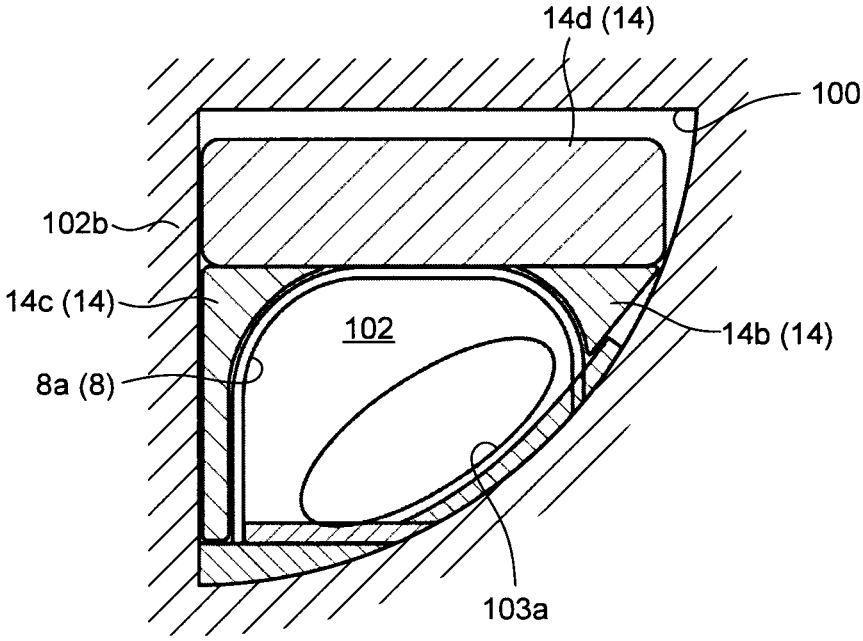
FIG. 12 depicts a step of installing the container shown in FIG. 7.
Figure 13:
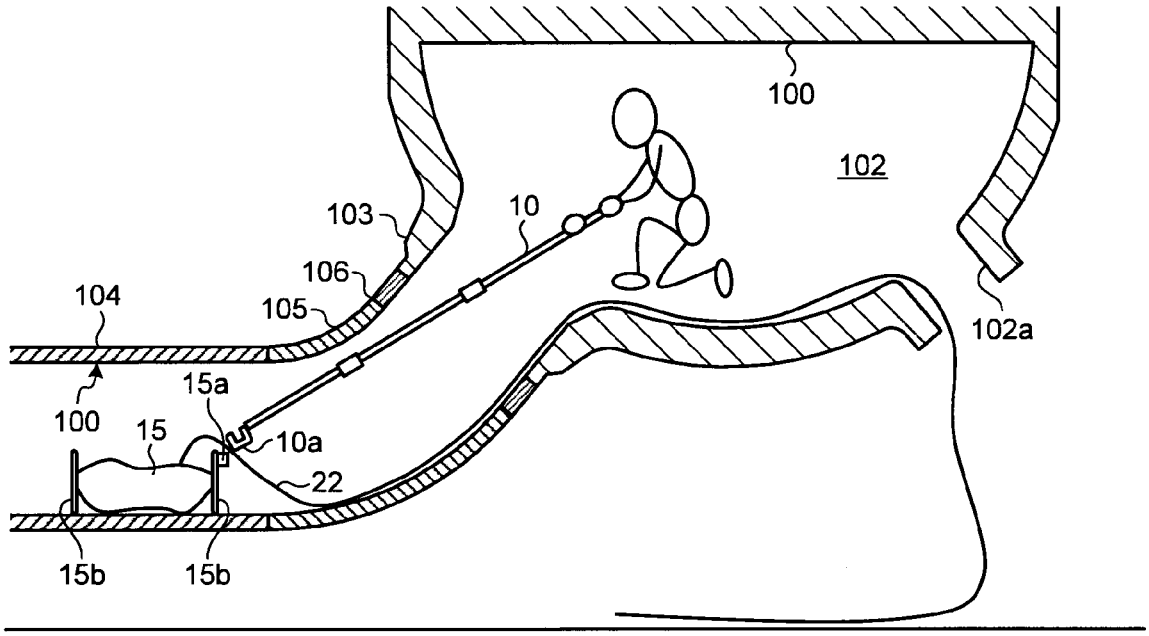
FIG. 13 depicts a step of installing the container shown in FIG. 8.
Figure 14:
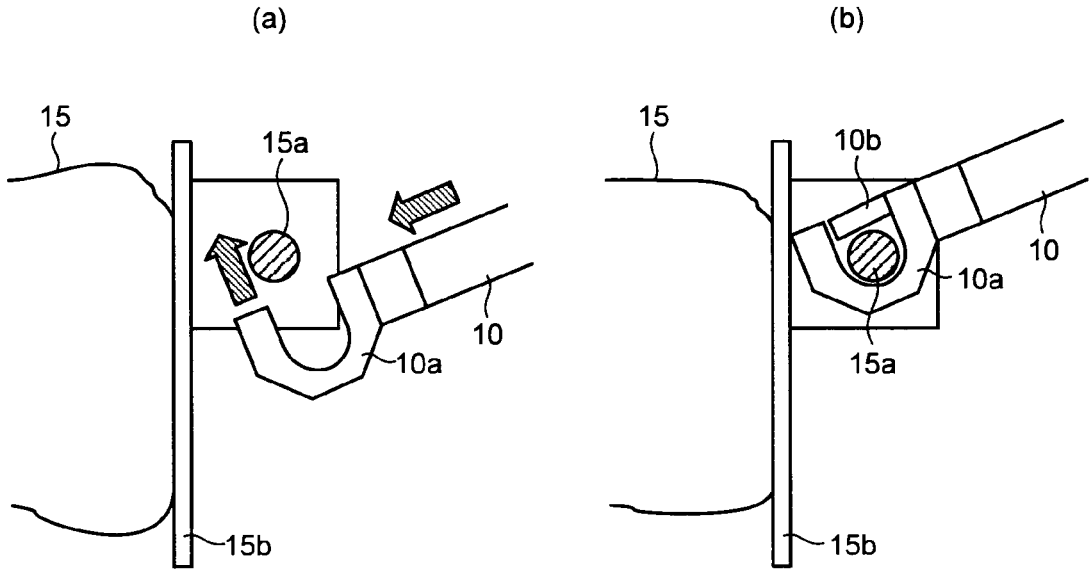
FIG. 14 depicts a step of installing the container shown in FIG. 8.
Figure 15:
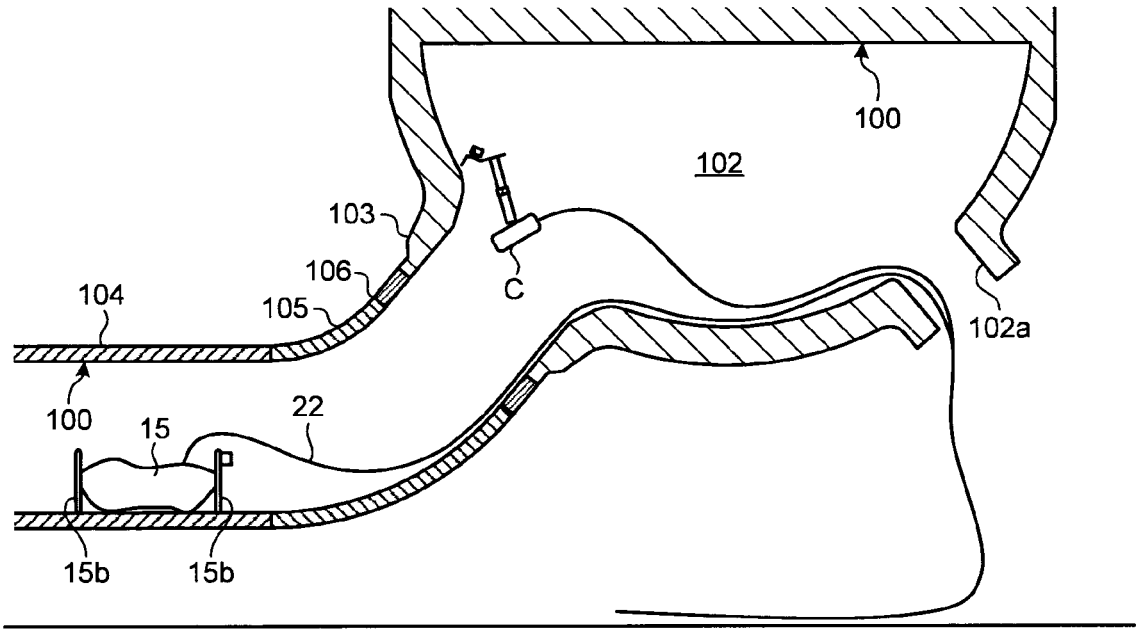
FIG. 15 depicts a step of installing the container shown in FIG. 8.
Figure 16:
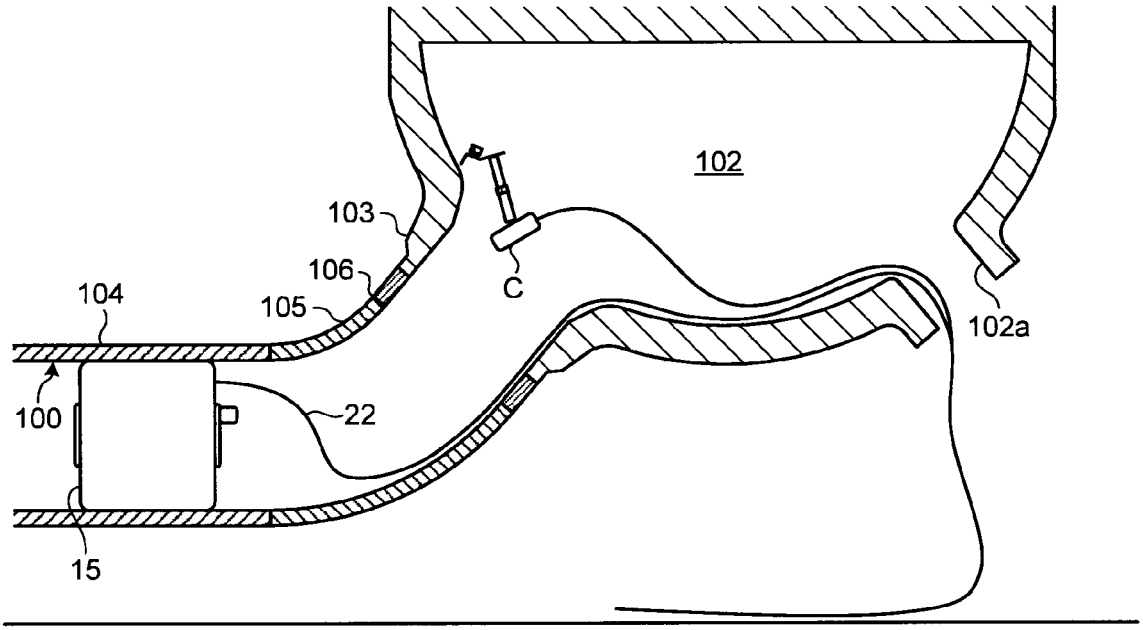
FIG. 16 depicts a step of installing the container shown in FIG. 8.

The container 14 forms a so-called balloon in which a shell made of urethane rubber or the like and having flexibility and retractility is covered by high frequency welding in a pouch-like shape so that the inside becomes hollow. The container 14 is put between the support member 8 installed inside the inlet-side water chamber 102 and an inner wall 100 of the inlet-side water chamber 102, and is divided into a plurality of parts. In the present embodiment, in FIGS. 7, 11, and 12 depicting a mode in which fluid is filled therein and the shell is inflated, the container 14 is divided into a first container 14*a* arranged in an inner region of the inlet-side water chamber 102 farthest from the manhole 102*a* (see FIGS. 7 and 11), a second container 14*b* arranged in a circular-arc side region of the inlet-side water chamber 102 (see FIGS. 11 and 12), a third container 14*c* arranged in a side region on a partition board 102*b* side of the inlet-side water chamber 102 (see FIGS. 11 and 12), and a fourth container 14*d* arranged in an upper region of the inlet-side water chamber 102 (see FIGS. 7, 11, and 12). A partition wall (not shown) that divides the hollow part into a plurality of rooms is provided in a container that shields a relatively large region such as the fourth container 14*d*, so that an inflated shape does not deform. The partition wall is made of a material same as that of the shell (urethane rubber or the like), and has a plurality of holes so that respective rooms communicate with each other. Although not shown, the containers 14 (14*a*, 14*b*, 14*c*, and 14*d*) are provided with the connection ports 1*a*, 1*b*, 1*c*, and 1*d* like in the container 1, and the injection nozzle 44 and the fetching member 45 are provided in the containers 14 (14*a*, 14*b*, 14*c*, and 14*d*) like in the container 1.

To install the containers 14 (14*a*, 14*b*, 14*c*, and 14*d*) inside the inlet-side water chamber 102, after the support member 8 is installed inside the inlet-side water chamber 102, the deflated first container 14*a* is arranged at a predetermined position between the support member 8 and the inner wall 100 of the inlet-side water chamber 102 and air is supplied thereto to inflate the first container 14*a*. The deflated second container 14*b* is arranged at a predetermined position between the support member 8 and the inner wall 100 of the inlet-side water chamber 102 and air is supplied thereto to inflate the second container 14*b*. The deflated third container 14*c* is arranged at a predetermined position between the support member 8 and the inner wall 100 of the inlet-side water chamber 102 and air is supplied thereto to inflate the third container 14*c*. Next, water is supplied to the first container 14*a*, the second container 14*b*, and the third container 14*c* in this order to replace air by water, and the shielding material is filled therein. The deflated fourth container 14*d* is then arranged at a predetermined position between the support member 8 and the inner wall 100 of the inlet-side water chamber 102 and air is supplied thereto to inflate the fourth container 14*d*, followed by supply of water to replace air by water, and the shielding material is filled therein.

The containers 14 (14*a*, 14*b*, 14*c*, and 14*d*) filled with the shielding material in this manner are combined in the inlet-side water chamber 102, to cover the opening 103*a* of the inlet nozzle 103 as a work area. Because the amount of radiation to the worker from the inner wall 100 of the inlet-side water chamber 102 is reduced by the containers (14*a*, 14*b*, 14*c*, and 14*d*) filled with the shielding material, the operation can be performed safely. Images of the condition of the containers 14 (14*a*, 14*b*, 14*c*, and 14*d*) can be taken by a camera and monitored by a monitor outside of a structure.

On the other hand, the container 15 shown in FIG. 8 forms a so-called balloon in which a shell made of urethane rubber or the like and having flexibility and retractility is covered by high frequency welding in a pouch-like shape so that the inside becomes hollow. Although not shown, the container 15 is provided with the connection ports 1*a*, 1*b*, 1*c*, and 1*d* like in the container 1, and the injection nozzle 44 and the fetching member 45 are provided in the container 15 like in the container 1.

Installation of the container 15 is performed according to procedures shown in FIGS. 8, and 13 to 16. First, the container 15 in which the shell is in a deflated mode, the feeding hose 22*a* is connected to the connection port 1*a*, and the returning hose 22*b* is connected to the connection port 1*b* is brought into the inlet-side water chamber 102 from the manhole 102*a* by a worker, and the container 15 is caused to slide from the inlet nozzle 103 into the primary cooling pipe 104 through the elbow pipe 105. When the position and orientation of the container 15, which is caused to slide into the primary cooling pipe 104, are not appropriate, the worker adjusts the position and orientation of the container 15 from the inlet-side water chamber 102, by using a guide member 10 (see FIG. 13).

The guide member 10 is a long stick and the length thereof can be adjusted by expanding and contracting the guide member 10. An upward U-shaped hook 10*a* and a lock pin 10*b* that opens and closes an opening of the hook 10*a* are provided at a tip of the guide member 10. The lock pin 10*b* is opened and closed on a base side of the guide member 10, which is held by a worker. The hook 10*a* is hooked on a locking part 15*a* provided in the container 15 in a state that the lock pin 10*b* is opened, and then the hook 10*a* is locked on the locking part 15*a* in a state that the lock pin 10*b* is closed. Therefore, the position and orientation of the container 15 can be adjusted without any need of the worker to enter into the primary cooling pipe 104 (see FIGS. 14(*a*) and 14(*b*)).

Further, when the container 15 with the shell being deflated is arranged in the primary cooling pipe 104, respective holding members 15*b* provided on both sides of the container 15 come in contact with an inner bottom face of the primary cooling pipe 104. That is, the holding members 15*b* form legs for arranging the container 15 inside the primary cooling pipe 104. Therefore, the container 15 before the shell is inflated can be maintained in the position and orientation adjusted inside the primary cooling pipe 104.

The worker then brings a camera C into the inlet-side water chamber 102 from the manhole 102*a*, and installs the camera C at a position where the container 15 can be checked from the inlet nozzle 103. The worker then exits the inlet-side water chamber 102, so that there is nobody in the structure. Accordingly, in the structure in an unmanned state, images of the condition of the container 15 are taken by the camera C. Images taken by the camera C are monitored by a monitor outside the structure (see FIG. 15).

Air is then supplied into the container 15. During sir supply, when it is confirmed from the images on the monitor that the position and orientation of the container 15 have changed due to inflation of the shell, a worker enters into the inlet-side water chamber 102 from the manhole 102*a*, to adjust the position and orientation of the container 15 by the guide member 10. In this manner, air is filled in the container 15, while monitoring the condition of the container 15 by the monitor outside the structure and appropriately adjusting the position and orientation of the container 15. Thereafter, water is supplied into the container 15 to replace air by water, and the shielding material is filled therein (see FIG. 16).

In this manner, the container 15 filled with the shielding material blocks the primary cooling pipe 104, while coming in contact with the inner wall 100 of the primary cooling pipe 104. Because the amount of radiation to a worker irradiated from the primary cooling pipe 104 toward the inlet-side water chamber 102 is reduced by the container 15 filled with the shielding material, the operation can be performed safely.

Figure 17:
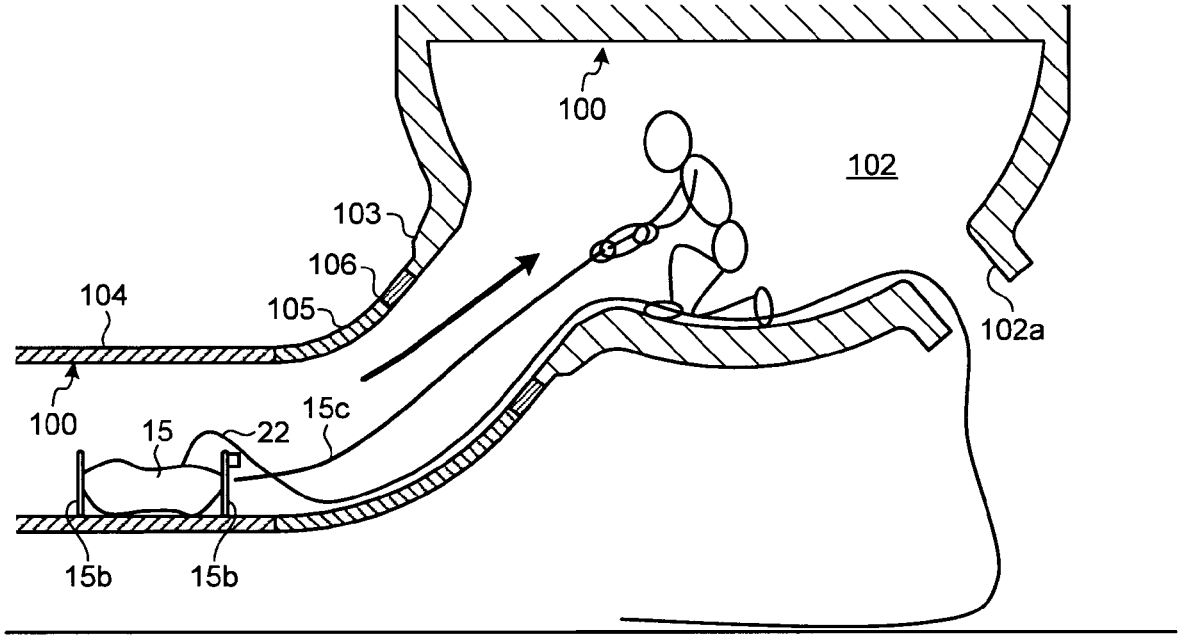
FIG. 17 depicts a step of removing the container shown in FIG. 8.
Figure 18:
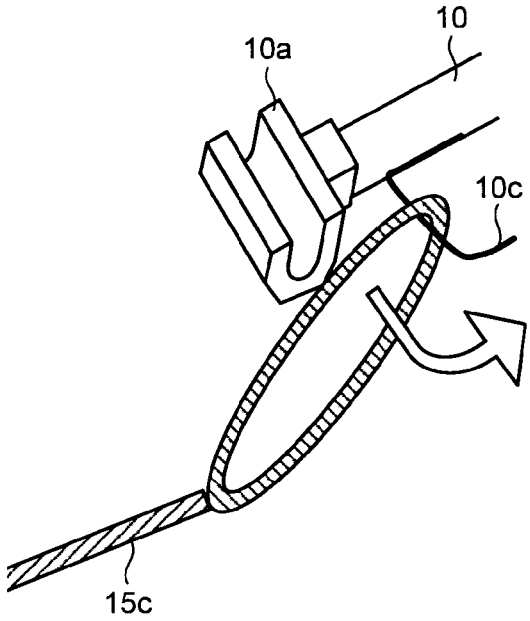
FIG. 18 depicts a step of removing the container shown in FIG. 8.

The container 15 is removed according to procedures shown in FIGS. 17 and 18. First, a worker enters into the inlet-side water chamber 102 from the manhole 102*a* to connect the feeding hose 42*a* to the connection port 1*c* of the container, and connect the returning hose 42*b* to the connection port 1*d*. The worker then extracts and recovers the shielding material from the container 15. Thereafter, the worker pulls up the container 15 with the shell being deflated from the primary cooling pipe 104 to the inlet-side water chamber 102 by the guide member 10 (see FIG. 17).

As shown in FIG. 18, an L-shaped hook 10*c* is provided at the tip of the guide member 10. On the other hand, a pull-up rope 15*c* is provided on the container 15, and a loop is formed at the end of the pull-up rope 15*c*. As shown in FIGS. 17 and 18, by hooking the hook 10*c* of the guide member 10 into the loop of the pull-up rope 15*c* and pulling it up, the pull-up rope 15*c* comes to hand of the worker. By holding the loop of the pull-up rope 15*c* and pulling the pull-up rope 15*c*, the worker can pull the deflated container 15 up to the inlet-side water chamber 102 (see FIG. 17). Finally, the container 15 is brought out to outside of the inlet-side water chamber 102 from the manhole 102*a*. The container 15 is removed in this manner.

As explained above, in the radiation shielding device according to the present embodiment, by applying various containers such as the containers 1, 11, 12, 13, 14, 15, it is possible to perform radiation shielding of various parts.

Industrial Applicability

As described above, the radiation shielding method and the radiation shielding device according to the present invention are suitable for easily and sufficiently reducing an amount of radiation to a worker.

Reference Signs List

1, 11, 12, 13, 14 (14*a*, 14*b*, 14*c*, 14*d*), 15 container
1*a*, 1*b*, 1*c*, 1*d* connection port
2 fluid feeding unit
21 tank
22 hose
22*a* feeding hose
22*b* returning hose
23 pump
3 shielding-material supply unit
4 shielding-material extracting unit
41 tank
42 hose
42*a* feeding hose

42*b* returning hose
43 pump
44 injection nozzle
44*a* injection port
45 fetching member
45*a* inlet
46 switching unit
46*a* first bypass pipe
46*b* second bypass pipe
46*c*, 46*d*, 46*e*, 46*f* switching valve
5 shielding-material recovering unit
5*a* filter
7 engaging member
100 object to be shielded (inner wall)
C camera
D shielding material

The invention claimed is:

1. A radiation shielding method comprising:

installing a hollow container at a predetermined portion of an object to be shielded;

feeding fluid into the container via a feeding hose;

supplying a shielding material to the feeding hose and transporting and filling a granular shielding material into the container by the fluid;

extracting the shielding material filled in the container from the container together with fluid discharged to outside of the container via a returning hose, while feeding fluid into the container via a feeding hose, in a state that the shielding material is filled in the container; and recovering the shielding material from the fluid, wherein the extracting the shielding material filled in the container from the container includes injecting the fluid, which is fed from the feeding hose to the returning hose, from an injection port formed in a tubular shaped injecting nozzle toward an inlet formed in a tubular shaped fetching member, the fetching member connected to the returning hose in the container, the inlet having a larger diameter than the injection port, and the inlet arranged so as to face the injection port.

2. The radiation shielding method according to claim 1, wherein at the feeding fluid into the container, liquid is used as the fluid and the liquid is filled in the container via the feeding hose.

3. The radiation shielding method according to claim 1, wherein the container is mounted on the object to be shielded at all times.

4. A radiation shielding device comprising:

a hollow container installed at a predetermined portion of an object to be shielded;

a fluid feeding unit that feeds fluid into the container via a feeding hose;

a shielding-material supply unit that supplies a granular shielding material to the feeding hose;

a shielding-material extracting unit that circulates the shielding material filled in the container together with fluid discharged to outside of the container via a returning hose, while feeding fluid into the container via a feeding hose; and a shielding-material recovering unit that recovers the shielding material from the fluid, wherein the shielding-material extracting unit includes an injection nozzle having a tubular shape and an injection port that injects the fluid fed into the container, and a fetching member having a tubular shape and an inlet for fetching the shielding material together with fluid discharged from the container, which are provided in the container, and an injection port of the injection nozzle is arranged toward the inlet of the fetching member, the inlet has a larger aperture than the injection port, and the inlet is disposed so as to face the injection port.

5. The radiation shielding device according to claim 4, wherein the shielding-material extracting unit includes a switching unit that switches a feeding direction of fluid in a reverse flow mode of the fluid.

6. The radiation shielding device according to claim 4, wherein the hose for circulating the shielding material together with fluid between the shielding-material supply unit and the container is made to be transparent.

7. The radiation shielding device according to claim 4, wherein the hose for circulating the shielding material together with fluid between the shielding-material recovering unit and the container is made to be transparent.

8. The radiation shielding device according to claim 4, wherein water is used as the fluid, and a pellet containing tungsten is used as the shielding material.

* * * * *